US009525934B2

(12) United States Patent
Ng et al.

(10) Patent No.: US 9,525,934 B2
(45) Date of Patent: Dec. 20, 2016

(54) STEERING VECTOR ESTIMATION FOR MINIMUM VARIANCE DISTORTIONLESS RESPONSE (MVDR) BEAMFORMING CIRCUITS, SYSTEMS, AND METHODS

(71) Applicant: STMICROELECTRONICS ASIA PACIFIC PTE LTD, Singapore (SG)

(72) Inventors: Samuel Samsudin Ng, Singapore (SG); Sapna George, Singapore (SG); Karthik Muralidhar, Bangalore (IN)

(73) Assignee: STMICROELECTRONICS ASIA PACIFIC PTE LTD., Singapore (SG)

( * ) Notice: Subject to any disclaimer, the term of this patent is extended or adjusted under 35 U.S.C. 154(b) by 70 days.

(21) Appl. No.: 14/588,288

(22) Filed: Dec. 31, 2014

(65) Prior Publication Data

US 2016/0192068 A1 Jun. 30, 2016

(51) Int. Cl.
*H04R 1/40* (2006.01)

(52) U.S. Cl.
CPC ..... *H04R 1/406* (2013.01); *H04R 2201/40* (2013.01)

(58) Field of Classification Search
CPC ..... H01Q 3/22; H01Q 3/26; G10K 11/346; G01S 7/52047; G01S 15/8915; H04R 3/00; H04R 3/005; H04R 2430/03; G10L 21/0232; G10L 2021/02082; G10L 2021/02166
USPC ..... 381/92
See application file for complete search history.

(56) References Cited

U.S. PATENT DOCUMENTS

| | | | | |
|---|---|---|---|---|
| 7,206,418 | B2 | 4/2007 | Yang et al. | |
| 8,098,842 | B2 | 1/2012 | Florencio et al. | |
| 2002/0152253 | A1* | 10/2002 | Ricks | H03H 21/0029 708/520 |
| 2005/0073457 | A1* | 4/2005 | Li | H01Q 3/22 342/368 |
| 2005/0094795 | A1 | 5/2005 | Rambo | |
| 2007/0127736 | A1 | 6/2007 | Christoph | |
| 2010/0106440 | A1* | 4/2010 | Richmond | G01S 3/74 702/71 |
| 2011/0307251 | A1* | 12/2011 | Tashev | G10L 21/028 704/231 |
| 2013/0287225 | A1* | 10/2013 | Niwa | H04R 3/00 381/92 |

OTHER PUBLICATIONS

Ba et al , "Enhanced MVDR Beamforming for Arrays of Directional Microphones," http://research.microsoft.com/pubs/146850/mvdr_icme2007.pdf, 4 pages, 2007.

(Continued)

*Primary Examiner* — David Ton
(74) *Attorney, Agent, or Firm* — Seed IP Law Group LLP

(57) ABSTRACT

A method of estimating a steering vector of a sensor array of M sensors according to one embodiment of the present disclosure includes estimating a steering vector of a noise source located at an angle θ degrees from a look direction of the array using a least squares estimate of the gains of the sensors in the array, defining a steering vector of a desired sound source in the look direction of the array, and estimating the steering vector by performing element-by-element multiplication of the estimated noise vector and the complex conjugate of steering vector of the desired sound source. The sensors may be microphones.

7 Claims, 4 Drawing Sheets

(56) References Cited

OTHER PUBLICATIONS

Boll, "Suppression of Acoustic Noise in Speech Using Spectral Subtraction," *IEEE Transactions on Acoustics, Speech, and Signal Processing ASSP*-27(2):113-120, Apr. 1979.
Buck et al., "Self-calibrating microphone arrays for speech signal acquisition: A systematic approach," *Signal Processing* 86:1230-1238, 2006.
Griffiths et al., "An Alternative Approach to Linearly Constrained Adaptive Beamforming," *IEEE Transactions on Antennas and Propagation AP*-30(1):27-34, Jan. 1982.

* cited by examiner

STEERING VECTOR ESTIMATION FOR MINIMUM VARIANCE DISTORTIONLESS RESPONSE (MVDR) BEAMFORMING CIRCUITS, SYSTEMS, AND METHODS

BACKGROUND

Technical Field

The present application is directed generally to microphone arrays, and more specifically to better estimating a steering vector in microphone arrays utilizing minimum variance distortionless response (MVDR) beamforming where mismatches exist among the microphones forming the array.

Description of the Related Art

In today's global business environment, situations often arise where projects are assigned to team members located in different time zones and even different countries throughout the world. These team members may be employees of a company, outside consultants, other companies, or any combination of these. As a result, a need arises for a convenient and efficient way for these distributed team members to work together on the assigned project. To accommodate these distributed team situations and other situations where geographically separated parties need to communicate, multimedia rooms have been developed to accommodate multiple term members in one room to communicate with multiple team members in one or more geographically separated additional rooms. These rooms contain multimedia devices that enable multiple team members in each room to view, hear and talk to team members in the other rooms.

These multimedia devices typically include multiple microphones and cameras. The cameras may, for example, capture video and provide a 360 degree panoramic view of the meeting room while microphone arrays capture and sound from members in the room. Sound captured by these microphone arrays is critical to enable good communication among team members. The microphones forming the array receive different sound signals due to the different relative positions of the microphones forming the array and the different team members in the room. The diversity of the sound signals received by the array of microphones is typically compensated for at least in part by adjusting a gain of each microphone relative to the other microphones. The gain of a particular microphone is a function of the location of a desired sound source and ambient interference or noise. This ambient noise may simply be unwanted sound signals from a different direction that are also present in the room containing the microphone array, and which are also received by the microphones. This gain adjustment of the microphones in the array is typically referred to as "beamforming" and effectively performs spatial filtering of the received sound signals or "sound field" to amplify desired sound sources and to attenuate unwanted sound sources. Beamforming effectively "points" the microphone array in the direction of a desired sound source, with the direction of the array being defined by a steering vector of the array. The steering vector characterizes operation of the array, and accurate calculation or estimation of the steering vector is desirable for proper control and operation of the array. There is a need for improved techniques of estimating the steering vector in beamforming systems such as microphone arrays.

BRIEF SUMMARY

A method of estimating a steering vector of a sensor array of M sensors according to one embodiment of the present disclosure includes estimating a steering vector of a noise source located at an angle θ degrees from a look direction of the array using a least squares estimate of the gains of the sensors in the array, defining a steering vector of a desired sound source in the look direction of the array, and estimating the steering vector by performing element-by-element multiplication of the estimated noise vector and the complex conjugate of steering vector of the desired sound source. The sensors are microphones in one embodiment.

DETAILED DESCRIPTION

Figure 1:
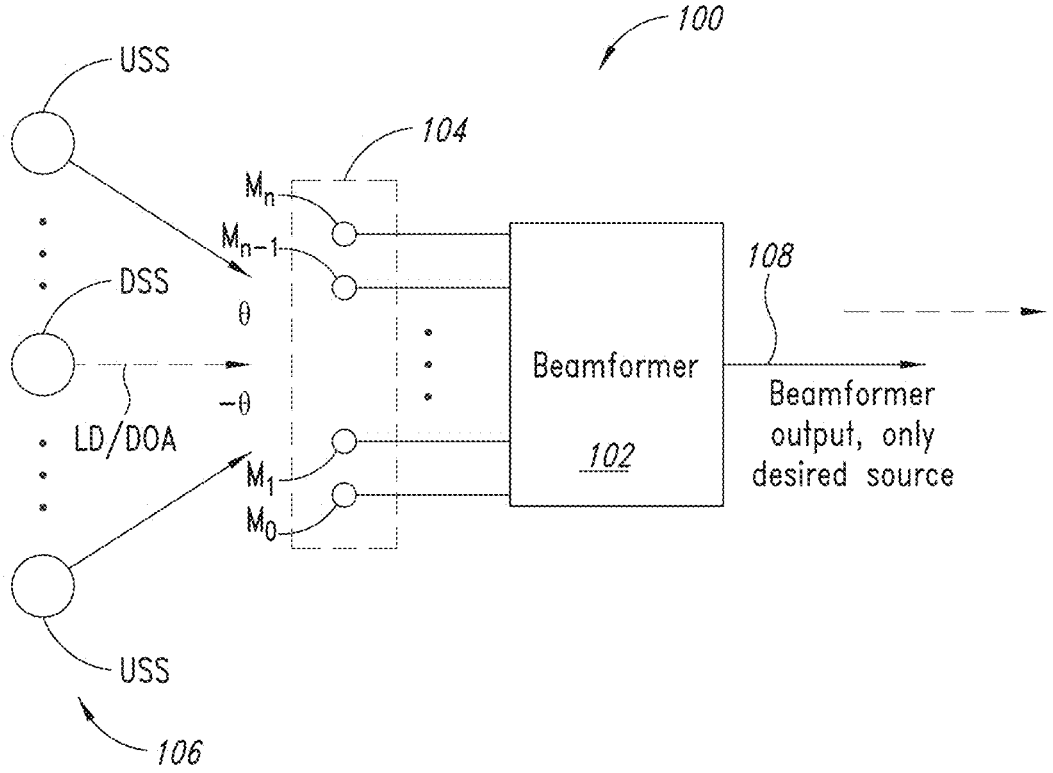
FIG. 1 is a functional diagram illustrating a typical beamforming environment in which a beamformer circuit processes signals from a microphone array to generate an output signal indicating sound received by the array from a desired sound source and to effectively filter sound received by the array from undesired sound sources.

FIG. 1 is functional diagram illustrating a typical beamforming system 100 in which a beamformer circuit 102 processes audio signals generated by a number of microphones $M_0$-$M_n$ of a microphone array 104 in response to sound waves or signals from a number of sound sources 106 to thereby estimate a steering vector d(f) of the array, as will be described in more detail below. The beamformer circuit 102 processes the signals from the microphone array 104 to generate an output signal 108 indicating the sound captured or received by the array from a desired sound source DSS (i.e., from a sound source in a direction relative to the array defined by the steering vector d(f) of the array), where the desired sound source is one of the number of sound sources 106. In this way, the beamforming circuit 102 effectively spatially filters sound received by the array 104 from undesired sound sources USS among the number of sound sources 106, as will be appreciated by those skilled in the art. In embodiments of the present disclosure, the steering vector d(f) is estimated in order to account for mismatch among the individual microphones $M_0$-$M_n$ of the microphone array 104, which can seriously degrade the performance of the beamformer circuit 102 and thus the quality of the output signal 108, as will be explained in more detail below.

In the following description, certain details are set forth in conjunction with the described embodiments of the present disclosure to provide a sufficient understanding of the disclosure. One skilled in the art will appreciate, however, that other embodiments of the disclosure may be practiced without these particular details. Furthermore, one skilled in the art will appreciate that the example embodiments described below do not limit the scope of the present disclosure, and will also understand that various modifications, equivalents, and combinations of the disclosed embodiments and components of such embodiments are within the scope of the present disclosure. Embodiments including fewer than all the components of any of the respective described embodiments may also be within the scope of the present disclosure although not expressly described in detail below. The operation of well-known components and/or processes has not been shown or described in detail below to avoid unnecessarily obscuring the present disclosure. Finally, also note that when referring generally to any one of the microphones $M_0$-$M_n$ of the microphone array 104, the subscript may be omitted (i.e., microphone M) and included only when referring to a specific one of the microphones.

Figure 2:
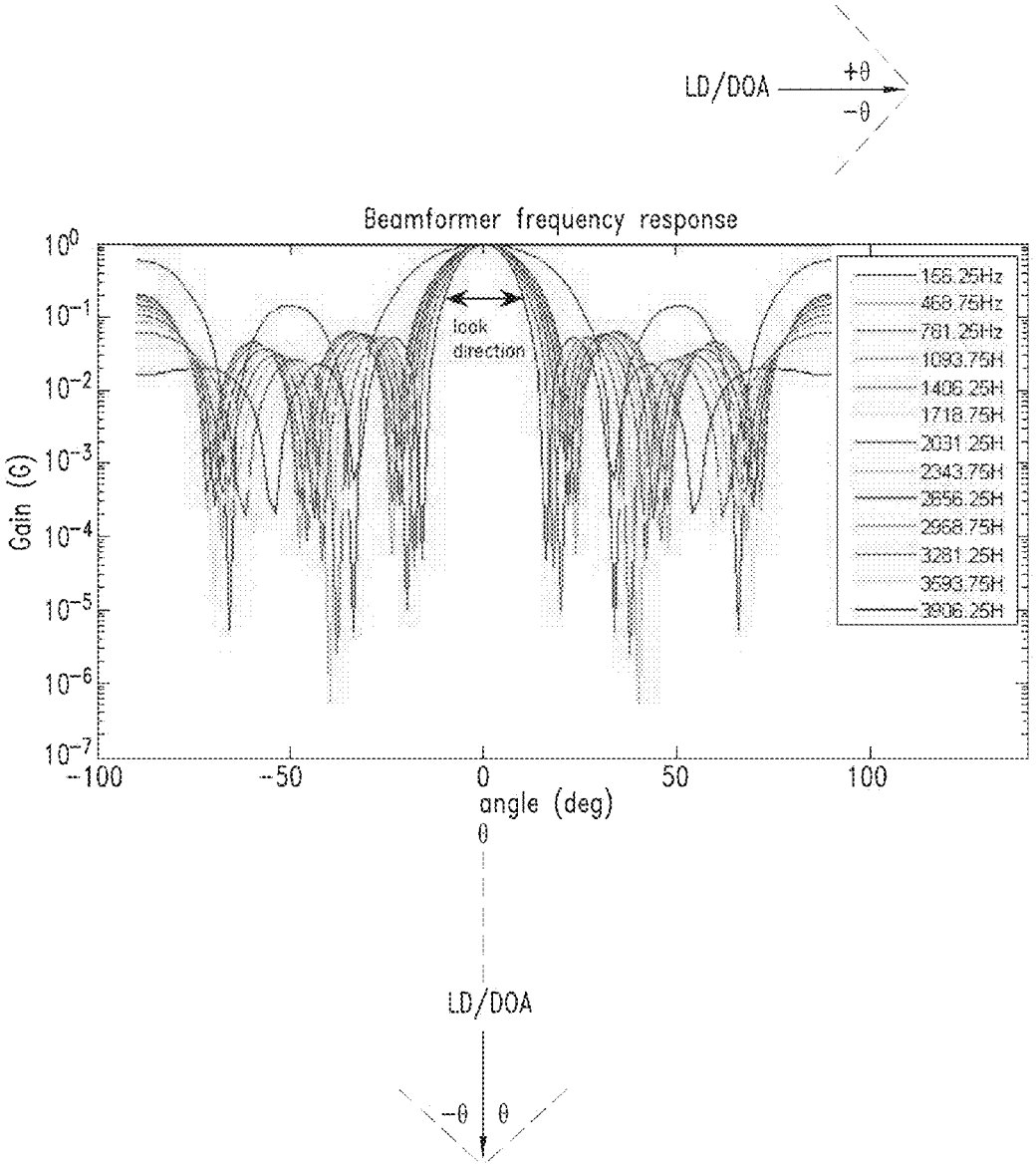
FIG. 2 is a graph illustrating typical spatial filtering of the beamformer circuit and microphone array of FIG. 1.

FIG. 2 is a graph illustrating typical frequency response or spatial filtering of a beamforming circuit and microphone array, such as the beamformer circuit 102 and microphone array 104 of FIG. 1. In the graph of FIG. 2, the vertical axis is the gain G of the beamformer circuit 102 while the horizontal axis is the arrival angle θ of sound waves impinging upon the microphones $M_0$-$M_n$ of the array 104, where the look direction LD or direction of arrival (DOA) has an arrival angle θ of zero degrees in the examples of FIGS. 1 and 2. When sound waves from the desired sound source DSS (see FIG. 1) is from the look direction LD the microphone array 104 exhibits the maximum gain G as seen in the figure. Moving to the left or counterclockwise from the look direction the angle θ is negative while moving to the right or clockwise from the look direction LD the angle θ is positive, as seen along the horizontal axis in the graph of FIG. 2. This is also illustrated through a drawing in the lower portion of FIG. 2 under the graph in upper portion of the figure.

As seen in FIG. 2, as the angle θ increases negatively or positively from the look direction LD (i.e., angle θ=0°) the gain G of the microphone array 104 tends to decrease, although the gain is a function of the frequency of the sound waves being sensed by the microphones $M_0$-$M_n$. The different lines for the gain G as a function of arrival angle θ are for different frequencies of the sound waves impinging upon the microphones MO-Mn of the array 104. Human speech is a broadband source of sound, meaning human speech includes many different frequencies, and so FIG. 2 shows the gain G for sound waves at different frequencies in this broadband range. The range of the frequencies of the impinging sounds wave illustrated in the example of FIG. 2 is seen in the table in the upper right corner of the graph, and varies from 156.25 Hz to 3906.25 Hz. This is in the range of frequencies in human speech that is generally considered to be most important for speech intelligibility and recognition, as will be appreciated by those skilled in the art.

Figure 3:
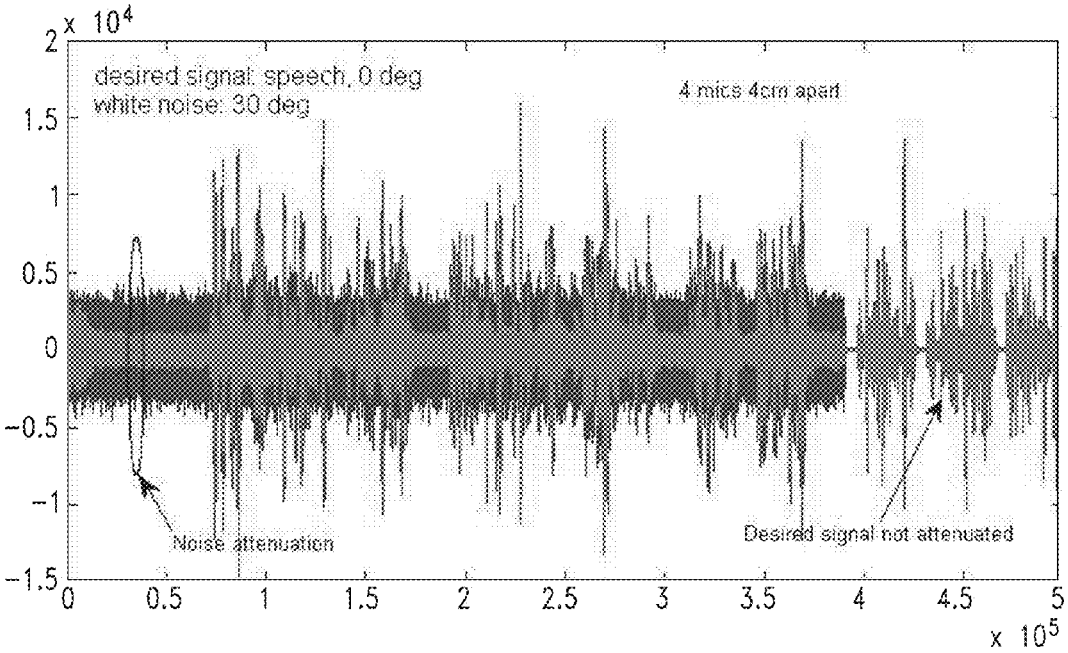
FIG. 3 is a graph illustrating the operation of the beamformer circuit and microphone array of FIG. 1 in capturing desired sound waves or speech signals incident upon the array from the look direction and in attenuating unwanted audio white noise incident on the array from a different angle.

FIG. 3 is a graph illustrating the operation of the beamformer circuit 102 and microphone array 104 in capturing desired sound waves or speech signals incident upon the array from the look direction LD (arrival angle θ=0°) and unwanted white noise incident on the array from an arrival angle θ=30°. In the example of FIG. 3, the microphone array 104 of FIG. 1 is assumed to include four microphones $M_0$-$M_3$ spaced 4 cm apart. The graph illustrates the magnitude (vertical axis of the graph of FIG. 3) of the output signal 108 (FIG. 1) over time (horizontal axis of graph) generated by the beamformer circuit 102 responsive to the desired speech signal and the unwanted white noise incident upon the microphone array 104 (FIG. 1). The lighter signal in FIG. 3 is the output signal 108 generated responsive to the desired speech signal (DSS of FIG. 1) incident upon the array 104 from the look direction LD (θ=0°). The darker signal in FIG. 3 is the output signal 108 generated responsive to the unwanted white noise signal incident upon the array 104 at an angle of θ=30° from the look direction LD. The unwanted white noise is attenuated while the desired speech signal from the look direction LD is not attenuated, which is the desired operation of the beamformer circuit 102.

Referring to FIG. 1 once again, different microphone array processing algorithms have been utilized to improve the operation of beamforming and to thereby improve the quality of the generated output signal 108 such that the output signal includes information for the desired sound source DSS while not including interference or noise corresponding to audio signals from the undesired sound sources USS. Embodiments of the beamformer circuit 102 utilize the minimum variance distortionless response (MVDR) algorithm, which is a widely used and studied beamforming algorithm, as will be appreciated by those skilled in the art. Assuming the direction-of-arrival (DOA) of a desired audio signal from the desired sound source DSS is known, the beamformer circuit 102 implementing the MVDR algorithm estimates the desired audio signal while minimizing the variance of a noise component of this estimated desired audio signal. The DOA of the desired audio signal corresponds to the look direction LD of the microphone array 104, and the arrow indicating this direction is accordingly designated LD/DOA in FIG. 1.

In practice, the direction-of-arrival DOA of the desired audio signal is not precisely known, which can significantly degrade the performance of the beamformer circuit 102, which may be referred to as the MVDR beamformer circuit in the following description to indicate that the beamformer circuit implements the MVDR algorithm. Embodiments of the present disclosure utilize a model for estimating directional gains of the microphones $M_0$-$M_n$ of the microphone array 104 of the sensor array 104. These estimates are determined utilizing the power of the audio signal received at each $M_0$-$M_n$ of the microphone array 104, where this power may be the power of the desired audio signal, undesired audio signals, or noise signals received at the microphones, as will be described in more detail below.

Before describing embodiments of the present disclosure, the notation used in various formulas set forth below in relation to these embodiments will now be provided. First, the various indices utilized in these equations are as follows. The index t is discrete time, the index f is frequency bin, the index n is the microphone index and the index k is the block index (i.e., index associated with a "block" of input time domain samples), and the total number of microphones in the array 104 is designated M. In certain instances, the same quantity can be indexed by t and f and the quantity will be understood by those skilled in the art from the context. For example, $x_n(f, k)$ is the frequency-domain value of the nth microphone signal in theffh bin and the kth block, while $x_n(t)$ is the nth microphone signal at the time t. The frequency bins are f=0, . . . , 2L−1 where 2L is the length of the Fast Fourier Transform (FFT). Furthermore, the leftmost microphone in a microphone array is designated as the zeroth microphone and the positive angle is on the right side and negative angle on the left side measured with respect to the normal of microphone array (i.e., in the look direction LD). Finally, the notation $\Sigma_v$ denotes the sum of all of the elements of the vector v.

In relation to the microphone array 104, and generally for other types of sensor arrays as well such as antenna arrays, the steering vector d(f) of the array defines the directional characteristics of the array. For a narrowband sound source corresponding to the fth bin, and located in the look direction LD of 0° of the microphone array 104, the sound source DSS having a magnitude results in a response in the nth microphone $M_n$ having a magnitude $d_n(f)d(f,k)$where $d_n(f)$ is the gain of the nth microphone. If it is assumed, without loss of generality, that for the 0th microphone (i.e., the leftmost microphone $M_0$ in the array 104) the gain is $d_0(f)=1$ then the steering vector d(f) for the fth bin is given by the equation:

$$d(f)=[d_0(f), \ldots, d_{M-1}(f)]^T \quad \text{Eqn. 1:}$$

where M is the total number of microphones in the array 104 as previously mentioned. If all microphones $M_0$-$M_n$ in the array 104 are matched and all microphones are equally spaced, then $d_0(f)= \ldots =d_{M-1}(f)$ and the steering vector is $d(f)=[1, \ldots ,1]^T$ since $d_0(f)=1$ was defined to be equal to 1.

Now consider a sound field formed by sound from the desired sound source DSS designated d(f) and including U undesired sound sources USS which are not in the look direction LD of the array 104, as seen in FIG. 1. Processing by the MVDR algorithm is block-based and in the frequency domain, as will be appreciated by those skilled in the art. Now let $x_n(f, k)$ be the frequency-domain value of the nth microphone signal in the fth bin and the kth block. This frequency-domain value $x_n(f, k)$ is obtained by taking the FFT of a block k of time domain samples denoted by $x_n(kL:kL+2L-1)$, where 2L is the length of the FFT as previously mentioned. Consecutive or adjoining blocks of input time domain samples may overlap by fifty percent (50%) and overlap addition utilized to smooth the transition from one block to another, as will be appreciated by those skilled in the art. Suitable windowing is also typically utilized on the blocks k of input time domain samples to reduce unwanted spectral effects that may arise from performing the FFT on the finite length blocks, as will also be appreciated by those skilled in the art.

Now let the microphone vector X(f, k) at the frequency binfand block k be defined as follows:

$$X(f, k)=[x_0(f, k), \ldots, x_{M-1}(f, k)]^T \quad \text{Eqn. 2}$$

where M is the total number of microphones $M_n$ in the array 104 as previously mentioned. Also let an interference contribution to the microphone vector X(f, k) due to the U undesired sound sources USS (FIG. 1) be designated I(f, k) for the frequency binfand block k. In this situation, the resulting microphone vector X(f, k) is as follows:

$$X(f, k)=d(f)d(f, k)+I(f, k) \quad \text{Eqn. 3:}$$

where d(f) is the steering vector, d(f, k) is the magnitude of the desired sound source DSS, and I(f, k) the interference contribution from the undesired sounds sources USS from other than the look direction LD.

The beamforming filtering, meaning the spatial filtering performed by the microphone array 104 having the steering vector d(f), is denoted by W(f) and is an [M×1] vector. As a result, the kth output value of output signal 108 (FIG. 1) at frequency bin f is as follows:

$$y(f)=W^H(f)X(f, k) \quad \text{Eqn. 4:}$$

where the superscript H of the filtering matrix W(f) is the Hermitian matrix of the filtering matrix W(f) having the characteristics that this Hermitian matrix is a square matrix with complex entries such that in this matrix the element $a_{ij}$ in the ith row and jth column is equal to the complex conjugate of the element in the jth row and ith column (i.e., $a_{ij}=(a_{ji})^*$).

Now assume y(t) is the time domain output signal 108 (FIG. 1) of the beamformer circuit 102 and is initialized to zero. The kth block of the output signal y(t) is determined as y(kL:kL+2L−1)=y(kL:kL+2L−1)+real (IFFT (y(f))) where real(.) denotes the real part of the Inverse Fast Fourier Transform (IFFT) of the frequency domain output signal y(J) (Eqn. 4) from the beamformer circuit 102 for frequency bin f. Only one half of the frequency bins fare processed in determining the filtering matrix W (f) because the beamforming system 100 of FIG. 1 is dealing with real signals, as will be appreciated by those skilled in the art. As a result, the filtering matrix is given by:

$$W(f)=W^*(2L-f), f=L+1, \ldots, 2L-1 \quad \text{Eqn. 5:}$$

The filtering matrix W(f) is determined such that $W^H(f)Q(f)W(f)$ is minimized and $W^H(f)d(f)=1$, where $Q(f)=E\{I^H(f, k)I(f, k)\}$ and corresponds to the energy of the interference contribution I(f, k). This interference contribution energy Q(f) is typically calculated over a R blocks where only the interference contribution I(f, k) from the undesired sounds sources USS is present and the magnitude d k) of the desired sound source DSS considered to be zero, which means when d(f, k)=0 then Eqn. 3 above becomes X(f, k)=I(f, k). This calculation of the interference contribution energy may be performed, for example, through one of the following:

$$Q(f) = \frac{1}{R}\sum_{k=0}^{R=1} I^H(f, k)I(f, k); \text{ or} \quad \text{Eqn. 6:}$$

$$Q(f) = \alpha Q(f) + (1-\alpha)I^H(f, k)I(f, k) \quad \text{Eqn. 7:}$$

where α is less than but close to one (1), such as 0.9, 0.99, and so on.

The MVDR beamformer algorithm is very sensitive to errors in the steering vector d(f). These errors can arise due to microphone mismatch caused by different gains among the microphones $M_n$. Errors may also arise due to location errors among the microphones $M_n$ and are caused by one or more of the microphones being a different location than expected and used in calculating the steering vector d . Error also may arise from direction of arrival (DOA) errors resulting from the desired sound source DSS not being precisely in the look direction LD, meaning if the desired sound sources is at other than zero degrees the steering vector d(f) must change accordingly. Of all these types of error, mismatch among the microphones $M_n$ is typically the type that results in the most significant degradation in performance of the beamformer circuit 102. As assumed in the above discussion and as is normally assumed, no mismatch among the microphones $M_n$ is assumed to exist, meaning the steering vector $d(f)=[1, \ldots, 1]_T$. When mismatches exist among the microphones $M_n$, however, and the estimated steering vector $d(f)=[1, \ldots ,1]^T$ is not accurate and the performance of the beamforming circuit 102 is degraded, potentially significantly. More specifically, if mismatch among the microphones $M_n$ exists and the steering vector $d(f)=[1, \ldots, 1]^T$ is utilized, the performance of MVDR algorithm deteriorates significantly in the sense that even the desired signal form the desired sound source DSS gets attenuated. As a result, in the presence of mismatch of the microphones $M_n$, the steering vector d(f) should be more reliably estimated to ensure that no degradation of the desired signal occurs, or any such degradation is minimized or at least reduced.

A steering vector d(f) estimation algorithm according to one embodiment of the present disclosure will now be described in more detail. First, estimating the steering vector d(f) where only one undesired sound source USS is present will described according to a first embodiment. First an input vector $\overline{X}_i(f)$ for the ith microphone $M_n$ is defined as follows:

$$\overline{X}_i(f)=[x_i(f,1), \ldots, x_i(f, B)]^T. \quad \text{Eqn. 6:}$$

This input vector $\overline{X}_i(f)$ is for the frequency bin f and is over B noise blocks, meaning blocks where the desired signal from the desired sound source DSS is absent (i.e., assumed to equal zero). The index i goes from 0 to (M−1) where M is the total number of microphones $M_n$ in the array 104 so there is an input vector $\overline{X}_i(f)$ for each microphone $M_n$ and for each frequency bin f.

Next the steering vector $d_N(f)$ of a noise source NS located at an angle of θ degrees from the look direction LD in FIG. 1 is defined as follows:

$$d_N(f)=[\overline{d}_0(f), \ldots, \overline{d}_{M-1}(f)]^T \quad \text{Eqn. 7:}$$

where the overline corresponds to the complex conjugate of each of the gains of the microphones $M_n$ where n varies from 0 to (M−1).

Next, the steering vector $d_s(f)$ of the desired sound source is defined as follows:

$$d_s(f) = \left[0, e^{j2\pi(f-1)\frac{f_s d\sin(\theta)}{2Lc}}, \ldots, e^{j2\pi(f-1)(M-1)\frac{f_s d\sin(\theta)}{2Lc}}\right]^T \quad \text{Eqn. 8:}$$

where $f_s$ is a sampling frequency, c is the speed of sound, d is the distance between microphones, and the angle θ is in radians and is the direction of the desired sound source DSS.

From the above equations the input vector $\overline{X}_i(f)$ of an ith microphone is approximately given by the following:

$$\overline{X}_i(f)\approx\overline{d}_i(f)\overline{X}_0(f) \quad \text{Eqn. 9:}$$

where the complex conjugate of the gain $\overline{d}_i(f)$ of the ith microphone is estimated using least squares as follows:

$$\overline{d}_i(f) = \frac{\overline{X}_i^H(f)\overline{X}_0(f)}{\|\overline{X}_0(f)\|^2}. \quad \text{Eqn. 10:}$$

From the above estimations and equations, where the complex conjugate gain $\overline{d}_i(f)$ of the ith microphone from Equation 10 above is used in Equation 7 for the steering vector $d_N(f)$ of the noise source NS then the estimated steering vector d(f) of the array 104 is estimated as follows:

$$d(f)=d_N(f)\otimes d_s^* \quad \text{Eqn. 11:}$$

where the symbol ⊗ is element-by-element multiplication and the superscript asterisk indicates the complex conjugate of the steering vector $d_s(f)$ of the desired sound source as set forth in Equation 8 above.

This embodiment of estimating the steering vector d(f) of the microphone array 104 calculates the corrective magnitude and phase for the steering vector. Finally, note that sometimes the spectrum of the input vector $\overline{x}_i(f)$ of Eqn. 6 may include a defective spectrum and in this situation regularization may be applied to the input vector to compensate for this defective spectrum. In this situation, the input vector $\overline{X}_i(f)$ is defined as $\overline{X}_i(f)=[x_i(f, 1)+\delta, \ldots, x_i(f, B)+\delta]^T$ where δ is a small offset value.

Another embodiment of the present disclosure estimates the steering vector d(t) where one or more undesired sound sources USS are present and will now be described in more detail. In this situation, the input vector $\overline{X}_i(f)$ for the ith microphone $M_n$ is defined as follows:

$$\overline{X}_i(f)=[|x_i(f, 1)|^2, \ldots, |x_i(f, B)|^2]^T \quad \text{Eqn. 12:}$$

which is for the frequency bin f and is computed over B noise blocks where the desired sound signal from the desired sound source DSS is absent (i.e., assume equal to zero). Once again, the index i goes from 0 to (M−1) where M is the total number of microphones $M_n$ in the array 104 so there is an input vector $\overline{X}_i(f)$ for each microphone $M_n$ and for each frequency bin f. Comparing Eqn. 12 to Eqn. 6 above it is seen that in the latter equation the frequency domain values for the ith microphone and for a given frequency bin f for each of the noise blocks B are squared compared to Eqn. 6. Now if the magnitude of the ith microphone gain in the fth frequency bin is defined as $\tilde{d}_i(f)$ then the input vector $\overline{X}_i(f)$ for the ith microphone may be estimated as follows:

$$\overline{X}_i(f)\approx\tilde{d}_i^2(f)\overline{X}_0(f) \quad \text{Eqn. 13:}$$

Once again, when comparing Eqn. 13 to Eqn. 9 the similarity of the equations is noted, with the gain $\tilde{d}_i(f)$ of the ith microphone in the fth frequency bin in the latter equation being squared when compared to the gain $\overline{d}_i(f)$ used in equation 9.

While the gain $\overline{d}_i(f)$ was computed using Eqn. 10 the ith microphone gain $\tilde{d}_i(f)$ is estimated as follows:

$$\tilde{d}_i(f) = \sqrt{\frac{\overline{X}_i^H(f)\overline{X}_0(f)}{\|\overline{X}_0(f)\|^2}}. \quad \text{Eqn. 14:}$$

Alternatively, the ith microphone gain $\overline{d}_i(f)$ may also be computed as follows:

$$\tilde{d}_i(f) = \sqrt{\frac{\sum \overline{X}_i(f)}{\sum \overline{X}_0(f)}} \quad \text{Eqn. 15:}$$

The vector of the microphone gains is defined as:

$$\tilde{d}(f)=[\tilde{d}_0(f), \ldots, \tilde{d}_{M-1}(f)]^T \quad \text{Eqn. 16:}$$

and the steering vector of the desired sound source DSS defined as:

$$d_s(f) = \left[0, e^{j2\pi(f-1)\frac{f_s d\sin(\theta)}{2Lc}}, \ldots, e^{j2\pi(f-1)(M-1)\frac{f_s d\sin(\theta)}{2Lc}}\right]^T \quad \text{Eqn. 17:}$$

where the angle θ is the direction of the desired sound source DSS and is close to zero. Finally, in this embodiment the final steering vector d(f) is computed as follows:

$$d(f)=\tilde{d}(f)\otimes d_s(f) \quad \text{Eqn. 18:}$$

This embodiment calculates the magnitude of the estimated steering vector do and not the phase as with the first embodiment. Finally, as discussed in relation to the prior embodiment, the spectrum of the input vector $\overline{X}_i(f)$ may be defective and in this situation regularization may be applied to the input vector to compensate for this defective spectrum. In this situation, the input vector $\overline{X}_i(f)$ is defined as $\overline{X}(f)=[|x_i(f, 1)|^2+\delta, \ldots, |x_i(f, B)|^2+\delta]^T$ where δ is a small offset value.

Figure 4:
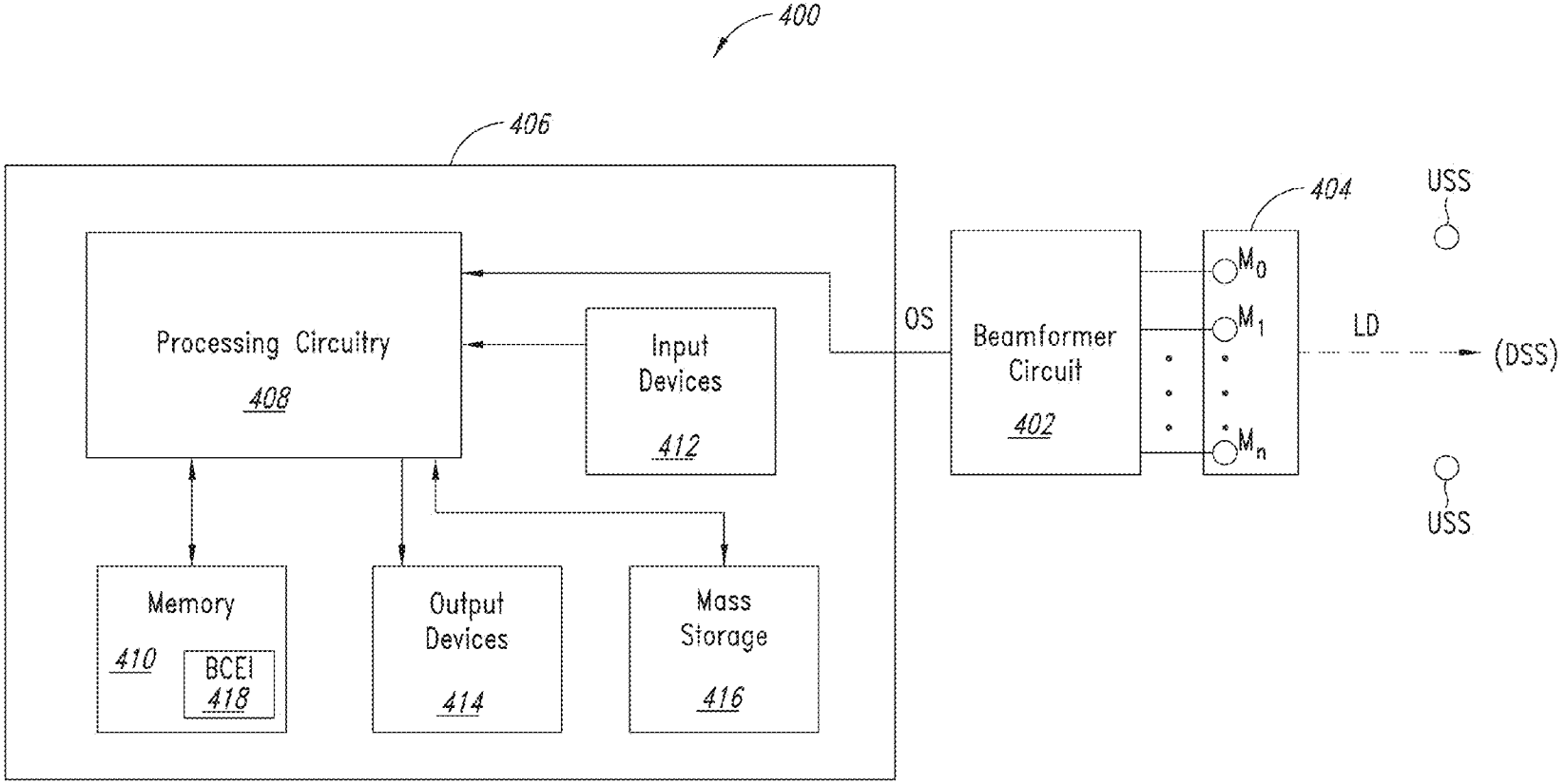
FIG. 4 is a functional block diagram of an electronic system including the beamformer circuit and microphone array of FIG. 1 according to one embodiment of the present disclosure.

FIG. 4 is a functional block diagram of an electronic system 400 including a beamformer circuit 402 and microphone array 404 that correspond to these same components 102 and 104 in FIG. 1 according to another embodiment of the present disclosure. The electronic system 400 includes an electronic device 406 coupled to the beamformer circuit 402 and which utilizes an output signal OS from the beamforming circuit in providing desired functionality of the system. The output signal OS corresponds to the output signal 108 of FIG. 1. The electronic device 406 may, for example, be a computer system or a dedicated conference room system that captures and audio and video of participants in the conference room containing the system and also receives audio and video captured from participants in another remote conference room. The array 104/404 may be linear array as shown in FIGS. 1 and 4, or the array may have a different configuration, such as a circular configuration or other type of configuration in alternative embodiments.

The beamformer circuit 402 is coupled to processing circuitry 408 in the electronic device 406 and the electronic device 406 further includes memory 410 coupled to the processing circuitry 408 through suitable address, data, and control buses to provide for writing data to and reading data from the memory. The processing circuitry 408 includes circuitry for performing various computing functions, such as executing specific software to perform specific calculations or tasks. The processing circuitry 408 would typically include a microprocessor or digital signal processor for processing the OS signal from the beamforming circuit 402. In addition, the electronic device 406 further includes one or more input devices 412, such as a keyboard, mouse, control buttons, and so on that are coupled to the processing circuitry 408 to allow an operator to interface with the electronic system 400. The electronic device 406 may also include one or more output devices 414 coupled to the computer circuitry 902, where such as output devices could be video displays, speakers, printers, and so on. One or more mass storage devices 416 may also be contained in the electronic device 406 and coupled to the processing circuitry 408 to provide additional memory for storing data utilized by the system 400 during operation. The mass storage devices 416 could include a solid state drive (SSD), a magnetic storage medias such as a hard drive, a digital video disk, compact disk read only memory, and so on.

Although shown as being separate from the electronic device 406 in FIG. 4, the beamformer circuit 402 and microphone array 404 may contained in the electronic device 406. In one embodiment, the beamformer circuit 402 corresponds to executable instructions stored in one or both of the memory 410 and mass storage devices 416. This is represented in FIG. 4 as beamformer circuit executable instructions (BCEI) 418 in the memory 410. In this situation, the microphone array 404 would be coupled directly to the electronic device 406 and the processing circuitry 408 would then initially capture the signals from the microphone array 404 and then execute the BCEI 418 to further process these captured signals.

One skilled in the art will understand that even though various embodiments and advantages of these embodiments of the present disclosure have been set forth in the foregoing description, the above disclosure is illustrative only, and changes may be made in detail and yet remain within the broad principles of the present disclosure. For example, the components described above may be implemented using either digital or analog circuitry, or a combination of both, and also, where appropriate, may be realized through software executing on suitable processing circuitry, as discussed with reference to FIG. 4. It should also be noted that the functions performed by the components 400-418 of FIG. 4 can be combined and performed by fewer components depending upon the nature of the electronic system 400 containing these components. Therefore, the present disclosure should be limited only by the appended claims.

The various embodiments described above can also be combined to provide further embodiments. All of the U.S. patents, U.S. patent application publications, U.S. patent applications, foreign patents, foreign patent applications and non-patent publications referred to in this specification and/or listed in the Application Data Sheet, including but not limited to U.S. Pat. Nos. 7,206,418 and 8,098,842, U.S. Patent Application Publication Nos. 2005/0094795 and 2007/0127736, and the following non-patent publications: Griffith and Jim, "An alternative approach to linearly constrained adaptive beamforming," IEEE Transactions on Antennas and Propagation, January 1982; Markus Buck, "Self calibrating microphone arrays for speech signal acquisitions: A systematic approach," Elsevier Signal Processing, October 2005; Boll, "Suppression of acoustic noise in speech using spectral subtraction," IEEE Transactions on Acoustics, Speech and Signal Processing, April 1979; "Microphone arrays—Signal processing techniques and applications", M. Brandstein, D. Ward, Springer; edition Jun. 15, 2001; Ivan Tashev, "Sound Capture and Processing," Wiley; and D Ba, "Enhanced MVDR beamforming for arrays of directional microphones," http://research.microsoft.com/pubs/146850/mvdr_icrme2007.pdf, all of which are incorporated herein by reference, in their entirety. Aspects of the embodiments can be modified, if necessary to employ concepts of the various patents, applications and publications to provide still further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A method of estimating a steering vector of a sensor array including M sensors, the method comprising:

estimating a first steering vector of a noise source located at an angle θ degrees from a look direction of the sensor array using a least squares estimate of the gains of the M sensors in the sensor array;

defining a second steering vector of a desired source in the look direction of the sensor array; and estimating the steering vector of the sensor array by performing element-by-element multiplication of the estimated first steering vector and the complex conjugate of second steering vector of the desired source.

2. The method of claim 1, wherein the sensor array comprises a microphone array of M microphones.

3. The method of claim 2, wherein the complex conjugate of the gain of the ith sensor in the sensor array including M sensors is estimated using least squares as follows:

$$\bar{d}_i(f) = \frac{\bar{X}_i^H(f)\bar{X}_0(f)}{\|\bar{X}_0(f)\|^2}$$

where $\bar{X}_i(f)$ is an input vector for the ith microphone in the fth frequency bin and $\bar{X}_0(f)$ is the input vector for the $0^{th}$ sensor of the M sensors of the sensor array.

4. An electronic system, comprising:

a sensor array including a plurality of sensors, each sensor having an associated gain and being configured to generate a respective electrical signals responsive to an incident wave;

a beamformer circuit coupled to the microphone array to receive the respective electrical signals from the plurality of sensors, the beamformer circuit configured to estimate a steering vector of the sensor array from an element-by-element multiplication of an estimated noise vector and the complex conjugate of a second steering vector of a desired source in a look direction of the sensor array, the beamformer circuit configured to estimate the noise vector from a least squares estimate of the gains of the plurality of sensors for a noise source located at an angle θ degrees from the look direction of the sensor array; and an electronic device coupled to the beamformer circuit.

5. The electronic system of claim 4, wherein the sensor array comprises a plurality of microphones, each microphone configured to generate a respective electrical signal responsive to an incident acoustical wave.

6. The electronic system of claim 5, wherein the electronic device comprises an audio/visual system.

7. The electronic system of claim 5, wherein the beamformer circuit is configured to calculate the complex conjugate of the gain of the ith sensor in the sensor array through least squares as:

$$\bar{d}_i(f) = \frac{\bar{X}_i^H(f)\bar{X}_0(f)}{\|\bar{X}_0(f)\|^2}$$

where $\bar{X}_i(f)$ is an input vector for the ith microphone in the fth frequency bin and $\bar{X}_0(f)$ is the input vector for the $0^{th}$ sensor of the plurality of sensors of the sensor array.

* * * * *